US006685527B2

(12) United States Patent
Johnson

(10) Patent No.: US 6,685,527 B2
(45) Date of Patent: Feb. 3, 2004

(54) TOY BANK

(76) Inventor: Joyce Johnson, P.O. Box 60805, Santa Barbara, CA (US) 03160

( * ) Notice: Subject to any disclaimer, the term of this patent is extended or adjusted under 35 U.S.C. 154(b) by 0 days.

(21) Appl. No.: 10/246,247

(22) Filed: Sep. 17, 2002

(65) Prior Publication Data

US 2003/0064656 A1 Apr. 3, 2003

Related U.S. Application Data

(60) Provisional application No. 60/326,797, filed on Oct. 2, 2001.

(51) Int. Cl.[7] ..... A45C 1/12; A63H 1/12

(52) U.S. Cl. ..... 446/10; 446/8; 232/4 R

(58) Field of Search ..... 446/8, 9, 10, 12, 446/13, 97; 232/4 R, 6; D21/161; 206/457; 220/4.26, 4.27, 4.21, 4.03; D99/34, 35, 37–39

(56) References Cited

U.S. PATENT DOCUMENTS

| | | | | | |
|---|---|---|---|---|---|
| 3,545,798 | A | * | 12/1970 | Swett | 403/326 |
| 4,356,659 | A | * | 11/1982 | Clarke | 446/97 |
| 5,069,645 | A | * | 12/1991 | Dworman et al. | 446/8 |
| 5,401,200 | A | * | 3/1995 | Ellis | 446/71 |
| D396,933 | S | * | 8/1998 | Boggs | D99/37 |
| 6,092,658 | A | * | 7/2000 | Pietrafesa | 206/457 |

* cited by examiner

*Primary Examiner*—Derris H. Banks
*Assistant Examiner*—Bena B. Miller
(74) *Attorney, Agent, or Firm*—Michael G. Petit

(57) ABSTRACT

An extendable, modular toy bank for storing coins and the like. The toy bank is substantially tubular and includes a head portion, a segmented extendable body portion and a tail portion. One of the portions, preferably the head portion, has a slot therein, dimensioned to receive a coin. The portions are hollow and, in combination, define an interior compartment. The body portion includes a plurality of tubular members, which may be bent, having forward and rearward ends that are adapted to be interconnected, end to end, by body segment connector rings placed therebetween, thereby elongating the body portion to increase the interior volume of the toy. A releasable locking mechanism on the ends of the head, body and tail portions of the toy interconnect with the body segment connector rings and enable the head, body and tail portions to be releasably attached to an adjacent tubular body portion segment of the device. All portions of the toy bank are preferably at least partially transparent in order to facilitate visual inspection of the interior of the bank. The toy bank is useful as a personal bank for storing coins. As the bank fills with coins or the like, additional segments of the body portion may be added via body segment connector rings to extend the length, and thus the capacity, of the bank. The overall visual appearance of the bank preferably bears a likeness to an appealing figure such as, for example, a caterpillar, a dog or a clown.

1 Claim, 4 Drawing Sheets

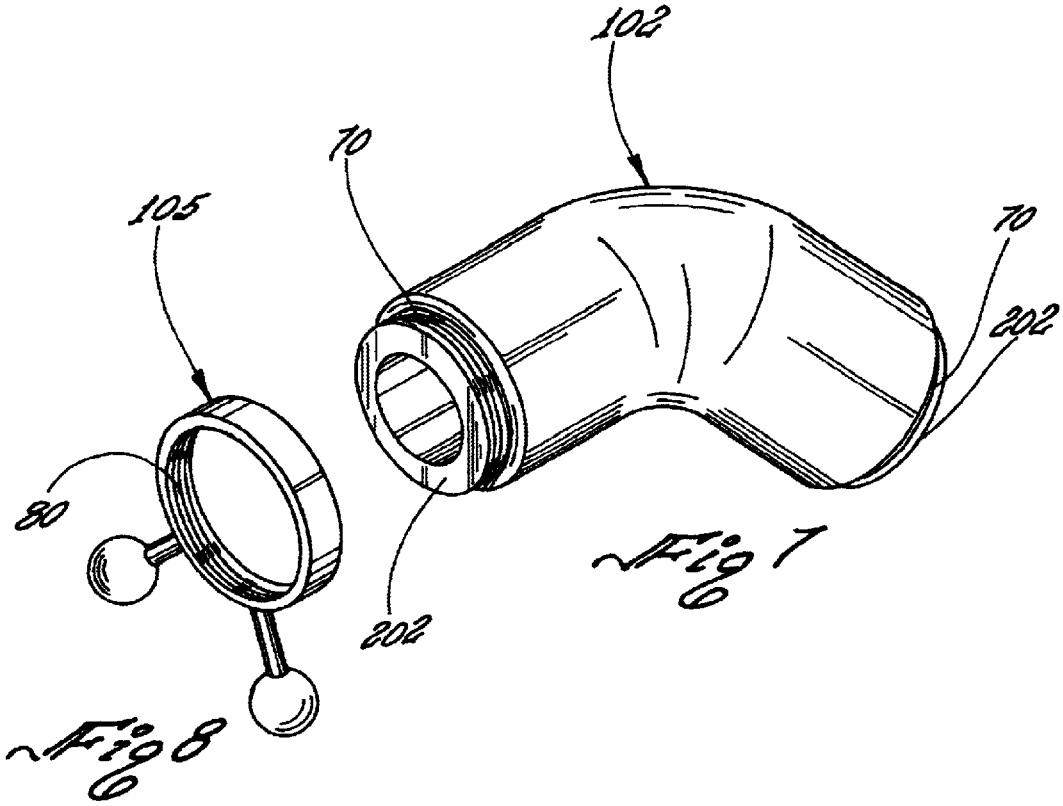
Fig 7
Fig 8
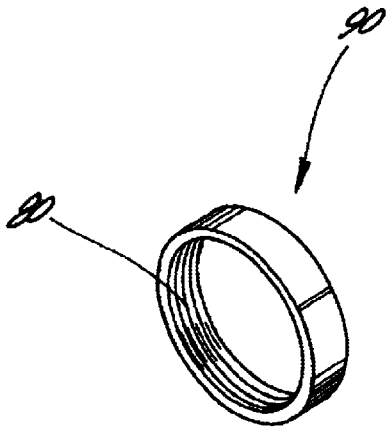
Fig 9
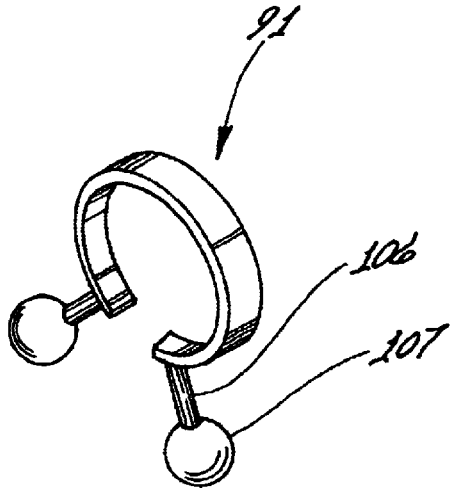
Fig 10

TOY BANK

This application claims the benefit of provisional application No. 60/326,797 filed Oct. 2, 2001.

BACKGROUND OF THE INVENTION

1. Field of the Invention

The present invention relates generally to toy banks, and more particularly to a modular toy bank wherein the capacity of the bank can be varied as desired.

2. Prior Art

Toy banks such as "piggy banks" have been used for generations to teach and encourage children to save money. Transparent toy banks are a particularly useful teaching tool because the child can see his/her savings grow before their own eyes. A problem with prior art toy banks is that once the bank is full, and no more coins can be stored therein, the bank must be emptied in order to continue to serve the function for which it is intended. Accordingly, the child cannot view further cumulative accrued savings once the bank is full. There is, therefore, a need for a toy bank having an expandable capacity to enable a person to continuously visualize cumulative savings.

SUMMARY

It is a first object of the invention to provide a toy bank having modular construction that is adapted to receive coins into an interior compartment and which further provides means for varying the capacity of the compartment.

It is a further object of the invention to provide a bank meeting the above objective wherein the toy bank further enables a viewer to visualize the cumulative content of the bank's compartment.

When the capacity of a coin bank is large relative to the size of a coin, the deposition of a coin in the bank is not as visually rewarding as when the coin is deposited in a bank having a smaller capacity. In the latter case, the addition of a coin to the bank fills a larger percentage of the capacity and in the event that the child's goal, when beginning to save, is to fill the bank, greater progress toward the goal is perceived. An overall objective of the present invention is to provide a toy bank for receiving coins wherein the capacity of the bank can be increased (or decreased) as interim goals are successively met.

In all embodiments of the modular, extendable toy bank in accordance with the present invention, the toy bank comprises: (a) a hollow head portion having a first interior chamber; (b) a body portion comprised of one or more hollow body portion segments, each of said hollow body portion segments having a second interior chamber and a pair of open ends in substantial opposition to one another; (c) a hollow tail portion having a third chamber; and (d) a plurality of body segment connector rings adapted for releasably attaching said head portion, said body portion segments and said tail portion to one another such that said first chamber, said second chambers and said third chambers form a single interior chamber. One or more of the body segments are preferably translucent to permit viewing of the contents of the single interior chamber.

The features of the invention believed to be novel are set forth with particularity in the appended claims. However the invention itself, both as to organization and method of operation, together with further objects and advantages thereof may be best understood by reference to the following description taken in conjunction with the accompanying drawings in which:

BRIEF DESCRIPTION OF THE DRAWINGS

FIG. 7 is a perspective view of a body portion segment having male protuberances projecting from opposing ends thereof with a threaded exterior surface.

FIG. 8 is a perspective view of an embodiment of a body segment connector ring having legs and feet projecting outwardly therefrom and a female thread on the inner surface thereof.

FIG. 9 is a perspective view of a legless and footless body segment connector ring having a threaded interior surface.

FIG. 10 is a perspective view illustrating "snap-on" ring having legs and feet that may be attached to either a body portion segment or a body portion segment connector ring to support the toy bank when a connector ring as shown in FIG. 9 is used to join adjacent body segments.

DESCRIPTION OF THE PREFERRED EMBODIMENTS

Figure 1:
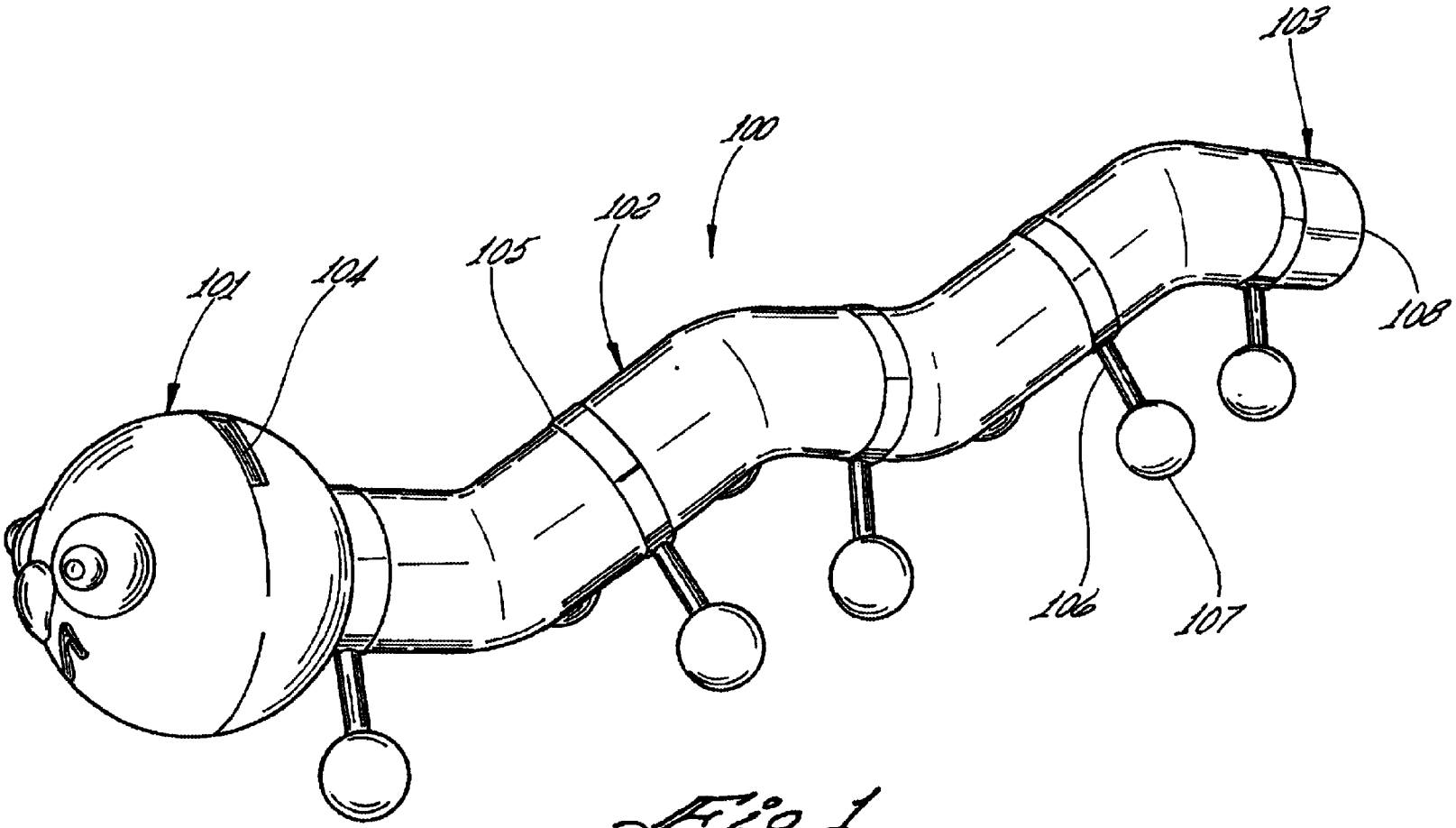
FIG. 1 is a perspective view of a modular toy bank in accordance with a caterpillar embodiment of the present invention.
Figure 2:
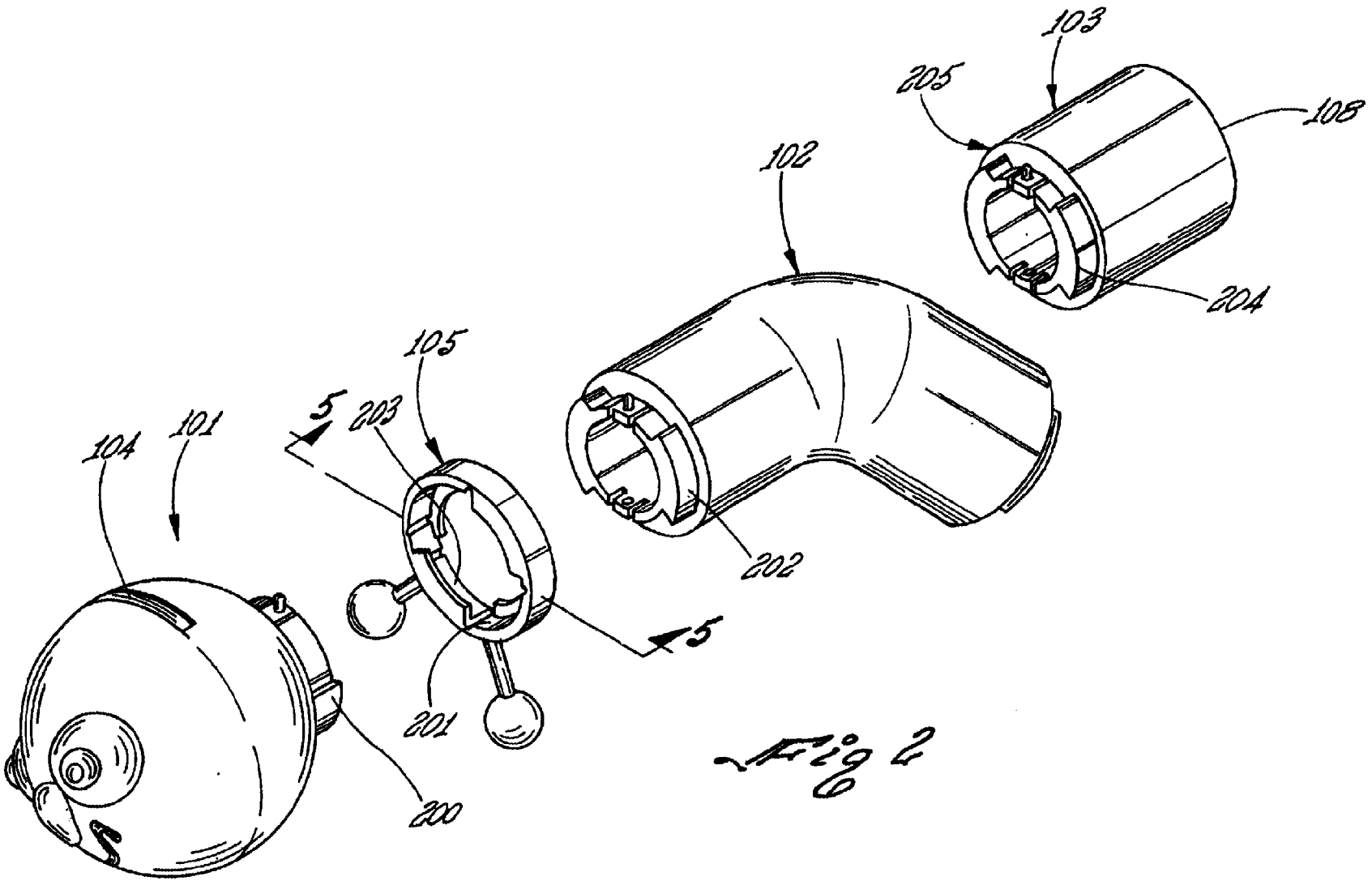
FIG. 2 is an exploded perspective view of the toy bank of FIG. 1 illustrating the modular construction of the bank.
Figure 5:
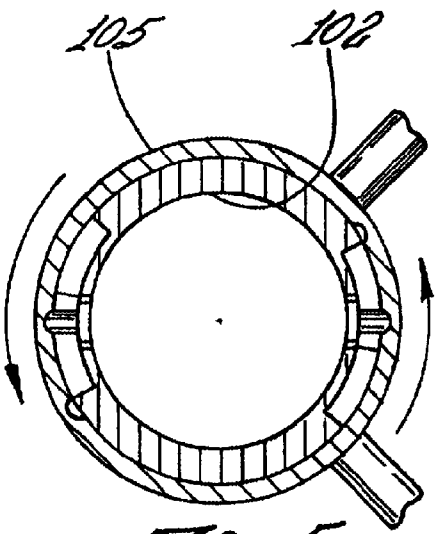
FIG. 5 is an end view taken in the direction of 5—5 in FIG. 2 showing the male end of a body segment inserted into the mating (female) end of body segment connecting ring.
Figure 6:
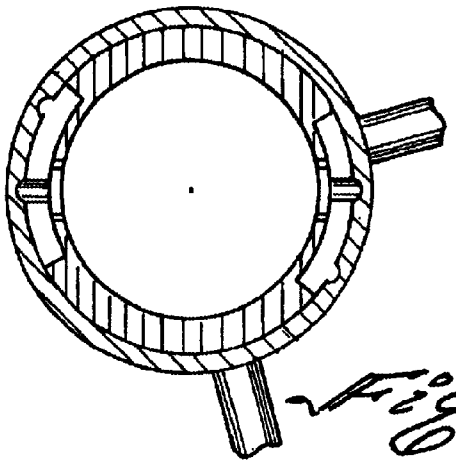
FIG. 6 is as shown in FIG. 5, after the body segment and the body segment connecting ring are rotated relative to one another to engage the components in a locked position.
Figure 3:
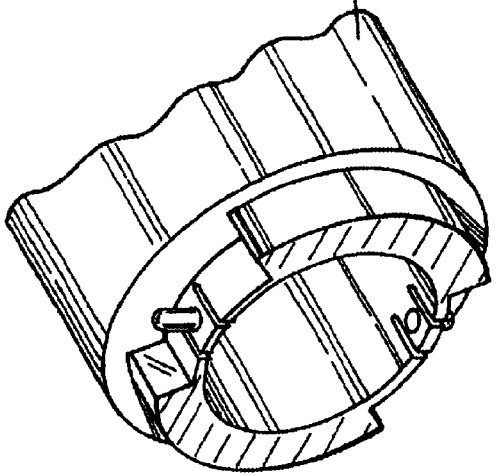
FIG. 3 is a perspective view of a male end of a body segment.
Figure 4:
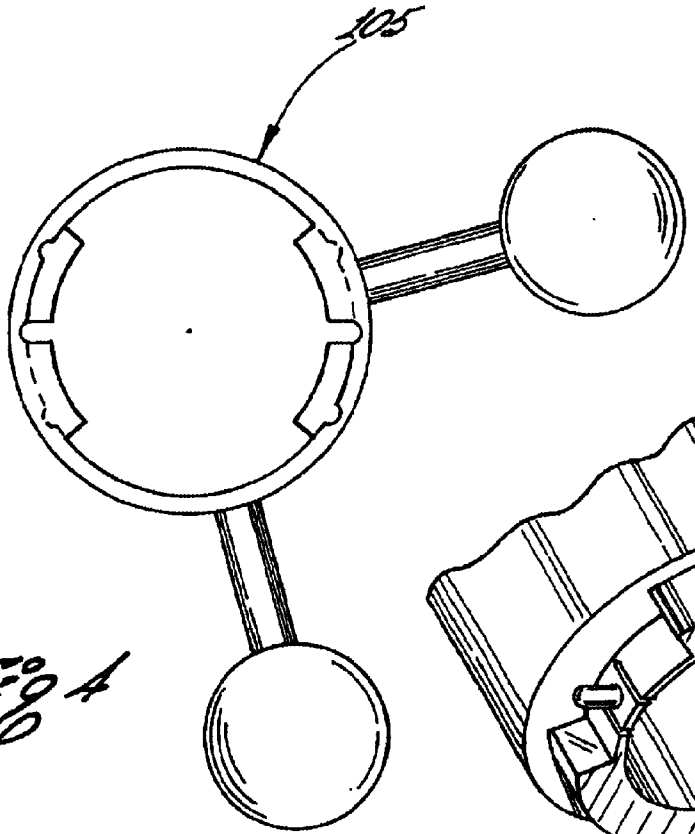
FIG. 4 is an end view of a body segment-connecting ring.

Turning now to FIG. 1, a caterpillar embodiment of a modular, extendable toy bank in accordance with the present invention is indicated at numeral 100. The toy bank 100 includes a head portion 101, a body portion 102 and a tail portion 103. The head portion 101 is hollow and has a slot 104 therein, the slot 104 being dimensioned to receive coins therein. Alternate positions for the slot 104 are indicated in phantom. The head portion has a neck with a male fitting 200 (FIG. 2) that matingly and rotationally engages a female fitting 201 (FIG. 2) on the interior surface of a body segment connector ring 105. Similarly, a body portion segment 102 has a male fitting 202 on one end thereof that rotationally engages a female fitting 203 on the interior surface of the opposing end of body segment connector ring 105. The toy bank 100, being both modular and extendable, may comprise more than one body portion; each such body segment being coupled end to end to one another by additional body segment connector rings 105 as needed to increase the interior volume (capacity) of the toy bank 100.

With continuing reference to FIG. 1, in the preferred embodiment 100 of a modular, extendable toy bank, each of the body portion segments 102 is a bent cylindrical tube comprised of an optically translucent material that may be colored as desired. The tail portion 103 has a male fitting 204 on the leading end 205 thereof. The trailing end 108 of the tail portion 103 is sealed to contain coins within the tortuous cylindrical compartment defined by, in combination, the modular head, body and tail portions. Each of the modular components 101, 102 and 103 are connected to one another by means of body segment connector rings 105. Details of an example of the male and female connectors on a body portion segment 102 and a body segment connector ring 105 are illustrated in FIGS. 3–6.

Other coupling means on the body segment connector rings may be used for the interconnection of tubular members such as male and female threads and bayonet mounts and to interconnect the body portion segments to the head and tail portions. For example, a body portion segment 102 and a body segment connector ring 105 that may be attached to one another via mating male and female threads to form a portion of the toy bank are illustrated in FIGS. 7 and 8. FIG. 7 is a perspective view of a body portion segment 102 having male protuberances 202 projecting from opposing ends thereof with a male threaded exterior surface 70. FIG. 8 illustrates in perspective view a body segment connector ring 105 having a female thread 80 on the inner surface thereof. The inner surface may further include a thread terminator to facilitate the proper orientation of adjacent body portion segments when they are screwed tightly into the connector ring 105.

FIG. 9 is a perspective view of a legless and footless body segment connector ring 90 having a threaded interior surface 80. The connector ring 90 preferably includes a break in the threaded surface to disposed to limit the depth of penetration of a male portion of a body segment screwed thereinto. FIG. 10 is a perspective view illustrating a "snap-on" ring having legs and feet depending therefrom that may be attached to either a body portion segment or a body portion segment connector ring to support the toy bank when a legless connector ring 90, as shown in FIG. 9, is used to join adjacent body segments.

In all embodiments of the modular, extendable toy bank for storing coins in accordance with the present invention, the toy bank comprises: (a) a hollow head portion having a first interior chamber; (b) a body portion comprised of one or more hollow body portion segments, each of said hollow body portion segments having a second interior chamber and a pair of open ends in substantial opposition to one another; (c) a hollow tail portion having a third chamber; and (d) a plurality of body segment connector rings adapted for releasably attaching said head portion, said body portion segments and said tail portion to one another such that said first chamber, said second chambers and said third chambers form a single interior chamber.

While particular embodiments of the present invention have been illustrated and described, it will be appreciated by the skilled artisan that various other changes and modifications can be made without departing from the spirit and scope of the invention. The modular construction permits extension of the body portion of many different embodiments of the toy bank. The term "body portion" or "extendable body portion" may apply to any portion of the bank exclusive of the tail and head portions, each of which head and tail portions being characterized by having only a single opening thereinto, exclusive of the slot. For example, the head portion may be a clown's head and the tail portion may be the remainder of a clown's body, exclusive of the neck, while the clown's neck may be extendable by connecting body segment portions to one another to elongate the neck. It is therefore intended to cover in the appended claims all such changes and modifications that are within the scope of this invention.

What I claim is:

1. A modular, extendable toy bank for storing coins comprising: (a) a hollow head portion having a first interior chamber; (b) a body portion comprised of at least one hollow body portion segment, said hollow body portion segment having a second interior chamber and a pair of open ends in substantial opposition to one another; (c) a hollow tail portion having a third interior chamber; and (d) a plurality of body segment connector rings adapted for releasably attaching said head portion, said body portion segment and said tail portion to one another such that said first interior chamber, said second interior chamber and said third interior chamber form, in combination, a single interior chamber when said head portion, said body portion segment and said tail portion are connected to one another by said connector rings, and wherein either said head portion, said body portion segment or said tail portion has a slot therein providing means for inserting a coin into said single interior chamber.

* * * * *